United States Patent [19]

Brown, Sr.

[11] 4,096,381

[45] Jun. 20, 1978

[54] ELECTRON IMAGE DETECTION SYSTEM

[76] Inventor: Robert L. Brown, Sr., 4805 Rutledge Dr. NW., Huntsville, Ala. 35805

[21] Appl. No.: 706,706

[22] Filed: Jul. 19, 1976

Related U.S. Application Data

[63] Continuation-in-part of Ser. No. 582,546, May 30, 1975, abandoned.

[51] Int. Cl.[2] ..... H01J 31/50

[52] U.S. Cl. ..... 250/213 VT; 313/485

[58] Field of Search ..... 250/213 R, 213 VT, 483, 250/486; 313/485, 486, 487, 488

[56] References Cited

U.S. PATENT DOCUMENTS

| | | | |
|---|---|---|---|
| 3,089,956 | 5/1963 | Harper | 250/213 VT |
| 3,107,303 | 10/1963 | Berkowitz | 250/213VT |
| 3,267,283 | 8/1966 | Kapany | 250/213 VT |
| 3,675,028 | 7/1972 | Grant | 313/486 |
| 3,783,298 | 1/1974 | Houston | 250/483 |

*Primary Examiner*—David C. Nelms

*Attorney, Agent, or Firm*—Nathan Edelberg; Robert P. Gibson; James T. Deaton

[57] ABSTRACT

An image detection system in which a subject is supported in a position for a source of electromagnetic rays to traverse at least a portion of the subject and have the traversing rays picked up by a photointensifier which directly converts the electromagnetic rays to light rays by use of a fiber optic type scintillator converter, directly converts the light rays to a projected electronic image by a cathode face, intensifies the projected electronic image, converts the intensified electronic image back to light rays and finally displays the converted light rays on a display surface to provide a positive and vivid photographic type image of the traversing rays on the display surface.

6 Claims, 1 Drawing Figure

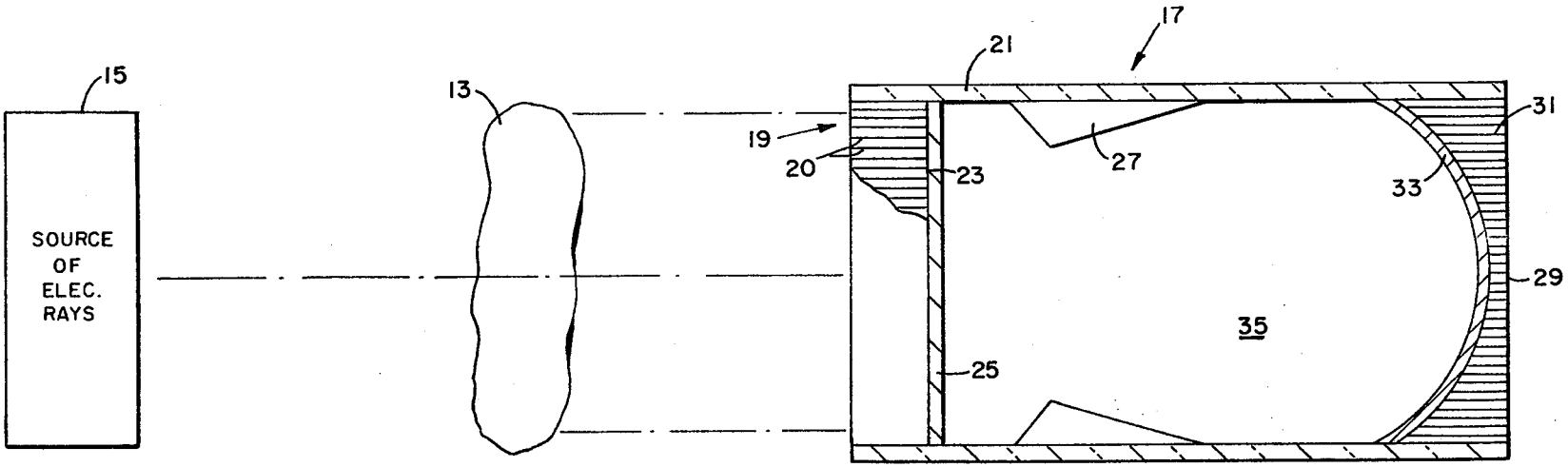
31
29
33
35
17
27
21
23
25
20
19
13
15
SOURCE OF ELEC. RAYS

ELECTRON IMAGE DETECTION SYSTEM

DEDICATORY CLAUSE

The invention described herein may be manufactured, used, and licensed by or for the Government for governmental purposes without the payment to me of any royalties thereon.

CROSS REFERENCE TO RELATED APPLICATION

This application is a continuation-in-part of applicant's copending application Ser. No. 582,546, filed May 30, 1975, now abandoned.

BACKGROUND OF THE INVENTION

In the past, various image intensifier devices have been developed for converting x-rays or other radiation into an electron image which is displayed as a photographic replica of the radiation. These devices have been inefficient in that they have had to either be incorporated into the vacuum intensifier tube itself or placed as a thin layer of material for converting the rays to light rays. In these prior art devices, there has always been the problem of scattering of the light rays once they are converted or distortion or destroying of a considerable portion of the radiation prior to or after its being converted to light rays. Devices of this type are depicted in U.S. Pats. such as No. 3,668,396 issued June 6, 1972 to Asars et al, No. 3,665,184 issued May 23, 1972 to Pieter Schagen, 3,628,080 issued Dec. 14, 1972 to Ter. T. Lindeqvist, No. 3,475,076 issued Oct. 28, 1969 to R. E. Nelson, No. 3,089,956 issued May 14, 1963 to John Harper, No. 3,107,303 issued Oct. 15, 1963 to D. A. Berkowitz, and No. 3,783,298 issued Jan. 1, 1974 to John M. Houston. There are probably other similar devices, however these are believed to amply illustrate the most closely related art to inventions of the type herein disclosed. In view of the prior art devices there is obviously a need for a device in which traversing rays from a subject can be directly received without interference such as from the glass face of a vacuum image intensifier tube or from a solid continuous layer of scintillator material that produces scattered type light rays or any other means in the path of the rays that would cause distortion of the image desired to be produced.

Therefore, it is an object of this invention to provide an image detection system in which the traversing rays from the subject are directly received at a face of a scintillator and transmitted from said scintillator as light rays for immediate impingement upon a cathode face which converts the light rays to an electron image.

Another object of this invention is to utilize an image detection system system which the scintillator thereof is used as the face of a vacuum image photointensifier tube.

A further object of this invention is to provide an image detection systems which utilizes a scintillator that is made of a fiber optic type structure in which the core material of the fiber optic structure has a scintillator material incorporated therein for converting electromagnetic rays to light rays.

Other objects and advantages of this invention will be obvious to those skilled in this art.

SUMMARY OF THE INVENTION

In accordance with this invention, an image detection system is provided that includes a source of electromagnetic rays for traversing a portion of a subject and impinging the traversing rays on a scintillating face of a vacuum photointensifier tube for display of the rays as a photographic type image on a display surface of the image photointensifier tube. The image photointensifier tube includes a scintillator that is made of a plurality of fiber optic type tubes that have a core material of conventional core glass with a scintillating material incorporated in the core glass for converting the electromagnetic rays to light rays. Each of the fiber optic type tubes has an outer conventional low index coating of cladding glass therearound for maintaining the converted light rays in its respective fiber optic type scintillator tube. The light emitted from each fiber optic type scintillator tube impinges immediately or directly on a cathode face that converts the light rays to an electron image that is transmitted through conventional focusing and accelerating electrodes to a conventional phosphor coated device for converting the intensified electron image back to light rays and transmission of the light rays through fiber optic tubes of the device to a display surface at the output end of the fiber optic tube array. With this type image detection system, a photographic type output image can be produced of the traversing rays with an equivalent television resolution in excess of 80 lines per mm.

BRIEF DESCRIPTION OF THE DRAWING

The single FIGURE of the drawing is a schematic view partially in section of an image detection system according to this invention.

DESCRIPTION OF THE PREFERRED EMBODIMENT

Referring now to the drawing, an image detection system according to this invention includes a position for support of a subject 13, a source 15 of electromagnetic rays such as conventional x-rays, $\alpha$-rays, $\gamma$-rays, neutron radiation or other source for traversing the subject in a conventional manner. The traversing rays are directly transmitted to a photointensifier image amplifier vacuum type tube 17 that has a scintillating material converter 19 that forms the face of photointensifier tube 17 by being hermetically sealed in a conventional manner to glass inclosure 21. Converter 19 has an inner face 23 on which a cathode face 25 of conventional construction and material such as cesium is mounted for direct or immediate impingement of the light rays from convertor 19 to form an electron image therefrom of the traversing rays. Photointensifier 17 also includes conventional focusing and accelerating electrodes 27 for intensification of the electron image transmitted from cathode face 25 to intensify a light image to be displayed at face 29 of fiber-optic window device 31 that has a conventional phosphor coated photocathode 33 for transforming the intensified electron image back into light rays for display as the light image at display surface 29. Fiber-optic window 31 is hermetically sealed to inclosure 21 to form a vacuum chamber 35 in a conventional manner within photointensifier 17.

One of the most important features in this invention lies in the converter 19 and its construction as used in this invention. Converter 19 includes contiguously disposed reflective light tubes 20 that are each in the form of fiber optics but having a phosphor scintillating material incorporated in the inner core material of the fiber optics. That is, each tube or fiber 20 has an inner core with a phosphoric substance therein for transforming the source of electromagnetic rays into light rays and for deposit of the light rays directly onto cathode face 25. An example of a typical inner core composition having good luminescence properties for converting traversing rays to be used in this invention is the following in weight-percent: 6.43 percent $Li_2O$, 77.14 percent $SiO_2$ and 16.43 percent BaO, with the addition of 3.0 weight percent $Al_2O_3$, 0.8 weight percent $CeO_2$, and 2.0 weight percent $NH_4F$. Other scintillating materials can be substituted for the lithium oxide in the inner core composition such as lead oxide in a percent up to about 15 percent or a uranium oxide in a percent up to as much as 25 weight percent. The exact inner core composition with its particular scintillator material will depend upon the type and penetrating ability of the input radiation it is desired to image. Each fiber optic tube 20 has a conventional outer type cladding glass that has a considerably less coefficient of optical refraction than the inner core material to serve as a good reflector to keep the light from escaping the inner core material except at the end of the fiber. Standard type cladding glasses such as "boron glass," "lime glass" or other standard type cladding glass compositions can be used as the cladding glass. Converter 19 with contiguously disposed tubes 20 can be fabricated by conventional methods known for fabricating fiber optic face plates. One particularly good method for fabricating the converter with the contiguously disposed optical tubes in which the tubes are hermetically sealed relative to each other to form a face for a vacuum tube is disclosed by the method set forth in the publication, Society of Photo-Optical Instrumentation Engineers entitled "Fiber Optics," Applications and Technology, Seminar Proceedings dated January 28–29, 1970, Dallas, Tex., and particularly pages 78 and 79 of this publication. As can be seen in this publication, it is well known to those skilled in this art as to how to fabricate face plates with small contiguously disposed tubes with various diameters of the converter as a whole. Tubes 20 generally have a length to diameter of approximately 100/1. It is to be understood that the length of tubes 20 will be varied in accordance with the magnitude of the electromagnetic radiation from the traversing ray source. With the present state of the art, a photographic type output image of the traversing rays with an equivalent television resolution in excess of 80 lines per mm can be produced. It is also noted that the publication "Nucleonics" published by McGraw-Hill, September 1962 on page 58, discloses uses for glass scintillators. Attention is also directed to the publication Society of Photo-Optical Instrumentation Engineers entitled "Fiber Optics" S.P.I.E. Seminar Proceedings Volume 14, copyright 1968 and particularly page 35 of this publication in which it is disclosed that fiber optic face plates are available in a variety of configurations and have been made with diameters up to 12 inches. That is, from the publications referenced above, it is believed that applicant has established that the art is well developed in the fabrication of fiber optic type face plates. The incorporation of the phosphoric substance or scintillating material in the core portion of the fiber optics does not hamper the fabrication of the scintillator tubes as fiber optic type tubes. From the above discussion, it is believed to be clear that converter 19 is made of a multiplicity of tubes 20 that are fabricated in a conventional manner in accordance with fiber optics technology and that each of the tubes has an inner core with the phosphoric substance or scintillating material as a portion of the core material for converting the electromagnetic rays traversing the subject to light rays that are only allowed to be emitted from the ends of the tubes.

In operation, when a subject 13 is subjected to electromagnetic rays from source 15, those traversing subject 13 immediately strike the face of converter 19 and are transmitted through tubes 20 and converted from electromagnetic rays to light rays by the scintillating material in each of tubes 20 to cause the light rays produced in tubes 20 to be transmitted for immediate and direct impingement on cathode face 25. Cathode face 25 transmits an electron image directly therefrom through conventional focusing and accelerating electrodes 27 to phosphor coated surface 33 that converts the electron image back to light rays for transmission through fiber optics 31 to display surface 29 which displays a positive and vivid photographic type image of the traversing rays on the display surface. As can be seen, in this particular device of applicant's, unnecessary distortions and interference from various objects in the path of the traversing rays to the display surface have been eliminated. This is made possible through the particular use of the converter 19 and its construction. Also, it should be noted that since converter 19 is made with the contiguously disposed reflective fiber optic type light tubes 20 with the scintillating material incorporated into the inner core of each fiber optic tube, the tubes have the capability of picking up even very low quantum energy electromagnetic rays as opposed to hard radiation. Therefore, it can be seen that converter 19 with its construction can pick up even low quantum electromagnetic rays and cause them to be transmitted in a most direct manner as light rays. By applicant discovering that this can be done, it makes it possible for the traversing electromagnetic rays to have an equivalent television resolution in excess of 80 lines per millimeter due to the effective manner that converter 19 can act upon the traversing rays. This obviously is a drastic improvement over the prior art devices in the vividness of the images that can be produced. For example, in prior art x-ray systems employing substantially many times the quantum of traversing electromagnetic rays, these devices have the capability of producing less than two equivalent television lines per mm. Not only is the harmful exposure of human bodies to radiation in the prior art x-ray systems reduced in the instant system, but the greater detail achieved makes medical determinations such as detections of cancer available at much earlier stages thereof. Also the value of increased detail is invaluable as a quality control to end the multitudinous aspects of materials inspection.

In the prior art references noted above, the structures of these devices include intervening electromagnetic wave absorbing and diffusing materials respectively to reduce the electromagnetic quantum efficiency of conversion accomplished by the structures. Without such intervening materials that interfere, the instant invention has a structure that is capable of producing a very vivid and definitive image even when exposed to electromagnetic waves of low quantum energies. It is to be understood also that applicant's device also has the capability of being used with electromagnetic waves of high quantum energies as well.

I claim:

1. An image detection system including a position for support of a subject comprising:

a source of electromagnetic rays for traversing at least a portion of the subject; a photointensifier with focusing electrodes, a display surface and a phosphor coated device for transmitting a light image to be displayed as an image on said display surface, and a converter device disposed for direct conversion of said traversing rays to light rays including reflective light tubes of fiber optic structure, contiguously disposed relative to each other and each light tube consisting of a core material that is the same material as that of each of the other light tubes and said core material consisting of a phosphoric substance enclosed with a reflecting cladding glass for emission of light rays therefrom responsive to said traversing rays and a cathode face disposed for impingement thereon of said light rays from said light tubes to provide an electron image of said traversing rays;

said phosphor coated device being disposed for directly receiving intensified projection of said electron image from said cathode face to provide a positive and vivid definitive image of said traversing rays on said display surface.

2. An image detection system as set forth in claim 1, wherein said photointensifier includes a glass inclosure interconnecting said converter device and said phosphor coated device, and wherein said phosphor coated device is a fiber optics bundle having a coat of phosphor on one end surface thereof and said display surface being on another end surface thereof.

3. An image detection system as set forth in claim 2, wherein said electromagnetic rays are selected from the group consisting of x-rays, $\alpha$-rays, $\gamma$-rays and neutron radiation.

4. An image detection system as set forth in claim 1, wherein said core material consists of about 6.43 weight percent $Li_2O$, about 77.14 weight percent $SiO_2$, and about 16.43 weight percent BaO, with the addition of about 3.0 weight percent $Al_2O_3$, about 0.8 weight percent $CeO_2$, and about 2.0 weight percent $NH_4F$.

5. An image detection system as set forth in claim 2, wherein said light rays emission from said light tubes have an equivalent television resolution in excess of 80 lines per mm.

6. An image detection system as set forth in claim 2, wherein said cathode face is mounted as a layer of cesium on an inner face of said converter.

* * * * *